US008151491B2

(12) United States Patent
Sarantakos

(10) Patent No.: US 8,151,491 B2
(45) Date of Patent: Apr. 10, 2012

(54) REVERSIBLE ARTICLE OF FOOTWEAR

(75) Inventor: Michael G. Sarantakos, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 709 days.

(21) Appl. No.: 12/062,029

(22) Filed: Apr. 3, 2008

(65) Prior Publication Data

US 2009/0249650 A1 Oct. 8, 2009

(51) Int. Cl.
*A43B 3/24* (2006.01)
*A43B 3/12* (2006.01)

(52) U.S. Cl. ..... 36/100; 36/101; 36/11.5

(58) Field of Classification Search ..... 36/100, 36/101, 103, 104, 112, 11.5, 23, 24, 52
See application file for complete search history.

(56) References Cited

U.S. PATENT DOCUMENTS

| | | | | |
|---|---|---|---|---|
| 2,409,813 | A | 10/1946 | Timson | |
| 2,490,916 | A | 12/1949 | Miller | |
| 3,928,927 | A * | 12/1975 | Brown et al. | 36/11.5 |
| 4,050,168 | A | 9/1977 | Pace | |
| 4,864,736 | A | 9/1989 | Bierk | |
| D307,972 | S | 5/1990 | Sebestik | |
| 4,958,446 | A | 9/1990 | Brown | |
| 5,615,496 | A | 4/1997 | Sharpstein | |
| 5,737,853 | A | 4/1998 | Smejkal | |
| 5,822,888 | A * | 10/1998 | Terry | 36/100 |
| 6,035,554 | A | 3/2000 | Duncan | |
| 6,427,363 | B1 | 8/2002 | Hunter | |
| 6,442,869 | B2 | 9/2002 | Coomes | |
| 6,640,464 | B2 * | 11/2003 | Hsin et al. | 36/11.5 |
| 6,792,697 | B2 | 9/2004 | Wright et al. | |
| 6,904,706 | B2 * | 6/2005 | Jones et al. | 36/11.5 |
| 7,117,615 | B2 | 10/2006 | Gerber | |
| 7,155,782 | B2 | 1/2007 | Napurano | |
| 7,222,442 | B2 | 5/2007 | Hillyer et al. | |
| 7,540,098 | B2 * | 6/2009 | Bast et al. | 36/11.5 |
| 7,694,436 | B2 * | 4/2010 | Mullen | 36/11.5 |
| 7,698,836 | B2 * | 4/2010 | Schmelzer et al. | 36/136 |
| 2002/0166258 | A1 | 11/2002 | Posa | |
| 2007/0137069 | A1 | 6/2007 | Patakos | |
| 2007/0261267 | A1 * | 11/2007 | Osborn | 36/15 |
| 2007/0266596 | A1 * | 11/2007 | Mann | 36/50.1 |
| 2009/0038181 | A1 * | 2/2009 | Loughnane | 36/94 |
| 2010/0011623 | A1 * | 1/2010 | Seckler et al. | 36/136 |

FOREIGN PATENT DOCUMENTS

| | | |
|---|---|---|
| FR | 2622410 | 5/1989 |
| JP | 10-014604 | 1/1998 |
| JP | 10014604 | 1/1998 |
| JP | 2003-052401 | 2/2003 |

* cited by examiner

*Primary Examiner* — Jila Mohandesi
*Assistant Examiner* — Melissa Lalli
(74) *Attorney, Agent, or Firm* — Plumsea Law Group, LLC

(57) ABSTRACT

An article of footwear including a strap and a fastener is disclosed. The article of footwear is reversible by configuring the article in two different positions. The article of footwear may include a sole having a first side configured to contact a ground surface in a first position and a second side configured to contact a ground surface in a second position. The article of footwear may include a strap that may be selectively affixed to the second side of the sole in a first position and the first side of the sole in a second position.

20 Claims, 9 Drawing Sheets

REVERSIBLE ARTICLE OF FOOTWEAR

BACKGROUND OF THE INVENTION

1. Field of the Invention

The present invention relates generally to footwear, and in particular the present invention relates to reversible articles of footwear with a strap.

2. Description of Related Art

Reversible footwear have been previously proposed. Imura (Japanese patent number 10014604-A) teaches a health sandal that promotes stimulation of the foot. Imura teaches a base sheet that includes a wavy uneven face and a back face that includes small projections. Imura also teaches a front thong that can be inserted through a through-hole in the apex of the base sheet. With this arrangement, both of the faces can be used as a top surface of the footwear in order to present proper stimulus for a foot.

The prior art design requires a through-hole in the base sheet that could wear or deform over time. There is a need in the art for a design that provides a more durable fastening system.

SUMMARY OF THE INVENTION

The invention discloses an article of footwear including a strap and a fastener. In one aspect, the invention provides an article of footwear, comprising: a sole including a first side configured to contact a ground surface in a first position and a second side configured to contact a ground surface in a second position; a strap including a first fixed end portion and a second fixed end portion, each fixed end portion being fixedly attached to a periphery of the sole; the strap further including a fastening portion that is disposed between the first fixed end portion and the second fixed end portion; a fastener including a first fastening member associated with the first side of the sole and a second fastening member associated with the second side of the sole; and where the fastening portion of the strap is configured to releasably attach to the second fastening member in the first position and where the fastening portion of the strap is configured to releasably attach to the first fastening member in the second position.

In another aspect, the first fastening member and the second fastening member are buttons.

In another aspect, the first fastening member is associated with a first indicia.

In another aspect, the second fastening member is associated with a second indicia.

In another aspect, the first indicia is different than the second indicia.

In another aspect, the first indicia and the second indicia are raised indicia.

In another aspect, the invention provides an article of footwear, comprising: a sole including a first side configured to contact a ground surface in a first position and a second side configured to contact a ground surface in a second position; a fastener including a first fastening member associated with the first side of the sole and a second fastening member associated with the second side of the sole; a strap including a fastening portion that is configured to releasably attach to the fastener; and where the first fastening member is disposed against the first side and the second fastening member extends above the second side in the first position and where the second fastening member is disposed against the second side and the first fastening member extends above the first side in the second position.

In another aspect, the first fastening member is flush with the first side in the first position.

In another aspect, the second fastening member is flush with the second side in the second position.

In another aspect, the strap includes a first side that is disposed away from the sole in the first position.

In another aspect, the strap includes a second side that is disposed away from the sole in a second position.

In another aspect, the first side of the strap has a first weave.

In another aspect, the second side of the strap has a second weave that is different from the first weave.

In another aspect, the first side of the strap has a different pattern than the second side of the strap.

In another aspect, the first side of the sole has a textured surface.

In another aspect, the second side of the sole has a smooth surface.

In another aspect, the invention provides an article of footwear, comprising: a sole including a first side configured to contact a ground surface in a first position and a second side configured to contact a ground surface in a second position; a strap including a first fixed end portion and a second fixed end portion, each fixed end portion being fixedly attached to a periphery of the sole; the strap further including a fastening portion that is disposed between the first fixed end portion and the second fixed end portion; a fastener including a first fastening member associated with the first side of the sole and a second fastening member associated with the second side of the sole; the first fastening member and the second fastening member configured to releasably attach to the fastening portion; and where the first fastening member is disposed adjacent to the first side of the sole and the second fastening member is disposed adjacent to the second side of the sole.

In another aspect, the first fastening member is disposed away from the first side of the sole in the second position.

In another aspect, the second fastening member is disposed away from the second side of the sole in the first position.

In another aspect, the fastener is configured to move with respect to the first side and the second side.

Other systems, methods, features and advantages of the invention will be, or will become apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION OF THE PREFERRED EMBODIMENTS

Figure 1:
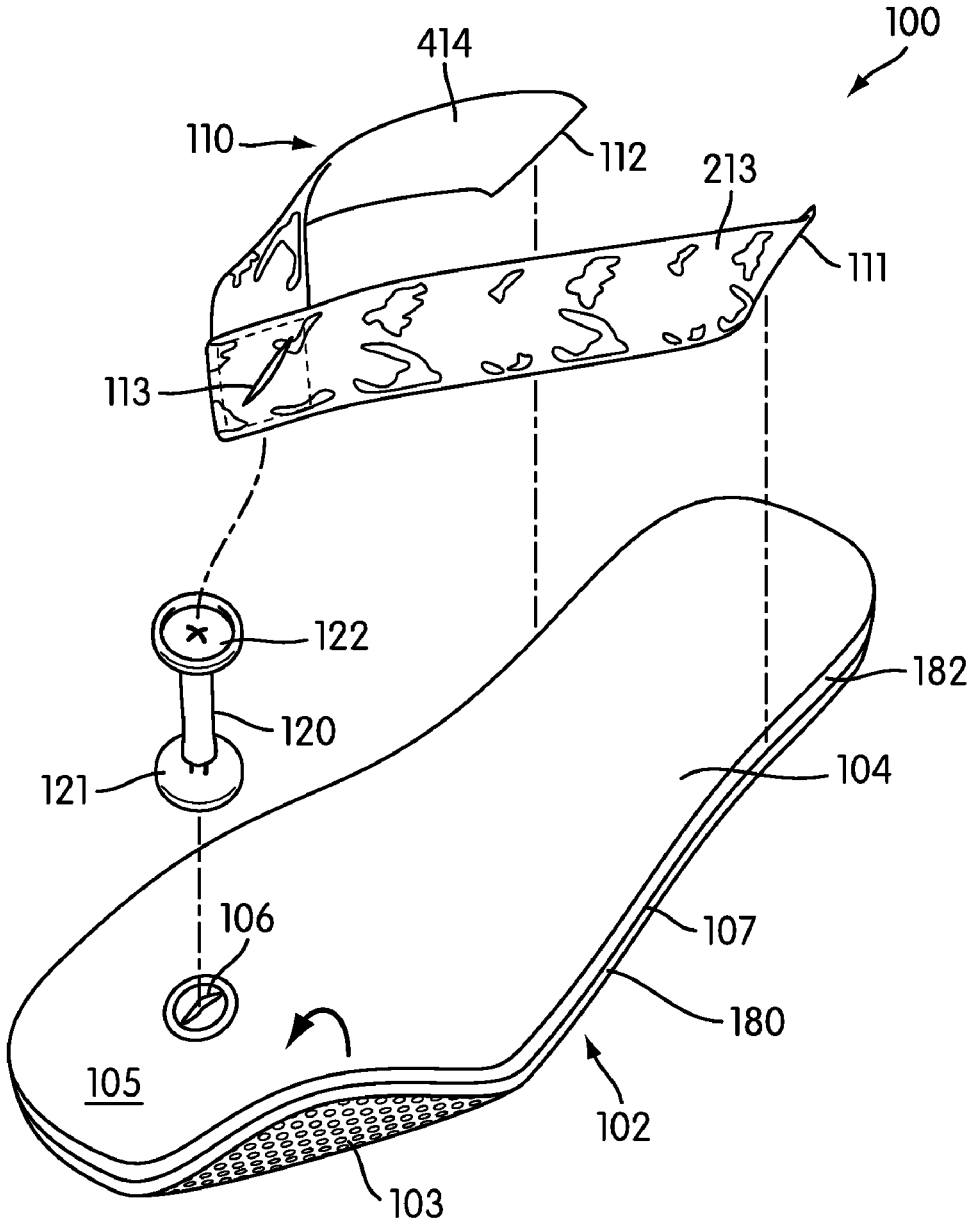
FIG. 1 is an exploded isometric view of a preferred embodiment of an article of footwear.

FIG. 1 is an exploded isometric view of a preferred embodiment of article of footwear 100 in the form of a flip-flop or thong. For clarity, the following detailed description discusses a preferred embodiment; however this description may also be applied to various other types of footwear such as sandals. Furthermore, for illustrative purposes, only a single article of footwear is shown in the present embodiment. However, it should be understood that a second article of footwear with all the features of article of footwear 100 may be associated with article of footwear 100 to create a pair of complementary footwear. The term "complementary", as used throughout this specification and in the claims, refers to an article of footwear configured for a left foot that is substantially a mirror image of an article of footwear configured for a right foot to create a pair of footwear.

Article of footwear 100 may include sole 102. Preferably, sole 102 includes first side 103. Sole 102 may also include second side 104 that is disposed opposite of first side 103. Typically, sole 102 may be flat, however, for illustrative purposes, sole 102 is bent in this Figure along forward portion 105. This arrangement preferably allows first side 103 of sole 102 to be seen.

In some embodiments, first side 103 and second side 104 may present similar types of surfaces. In other embodiments, first side 103 and second side 104 may present different types of surfaces. In some cases, for example, second side 104 may have a generally smooth surface. Additionally, first side 103 may have a generally textured surface. Examples of various textured surfaces include, but are not limited to, surfaces with small projections such as round bumps, surfaces with large projections such as strips, or tread-plates. In this embodiment, first side 103 has a textured surface with small round projections or bumps while second side 104 has a generally smooth surface. In other embodiments, first side 103 and second side 104 may have different types of textured surfaces.

Generally, sides 103 and 104 of sole 102 may include designs, patterns and/or colors. In some embodiments, sides 103 and 104 may be associated with different designs, patterns and/or colors. In a preferred embodiment, sides 103 and 104 include different solid colors.

In some embodiments, a sole may be manufactured from a single material. In other embodiments, a sole may be constructed from two or more materials attached by some means, including, but not limited to, adhesives, heat and/or pressure. In some cases, two identical sole shaped portions of different materials may be attached to create a sole. In a preferred embodiment, sole 102 may comprise first sole portion 180 and second sole portion 182. Preferably, first sole portion 180 and second sole portion 182 are joined together. Furthermore, first sole portion 180 may be associated with first side 103 and second sole portion 182 may be associated with second side 104.

Preferably, a sole includes provisions to secure the sole to a foot of a wearer. In some embodiments, a sole may be associated with multiple straps that pass over a foot of a wearer and/or ankle to secure the sole to the foot of a wearer. In other embodiments, a sole may be associated with two straps that fasten together to attach a sole to a foot of a wearer. In a preferred embodiment, a sole may be associated with a single strap that secures the sole to the foot of the wearer.

In the current embodiment, sole 102 may be associated with strap 110. Strap 110 preferably includes first fixed end portion 111 and second fixed end portion 112. Generally, strap 110 may be attached to sole 102 in any manner known in the art. In some cases, first fixed end portion 111 and second fixed end portion 112 may be glued to sole 102. In other cases, first fixed end portion 111 and second fixed end portion 112 may be glued between first sole portion 180 and second sole portion 182. In still other embodiments, first fixed end portion 111 and second fixed end portion 112 could be sewn to first sole portion 180 and/or second sole portion 182.

In some embodiments, first fixed end portion 111 and second fixed end portion 112 may attach to sole 102 some distance inward of periphery 107 of sole 102. In a preferred embodiment, first fixed end portion 111 and second fixed end portion 112 attach to sole 102 at periphery 107. With this arrangement, strap 110 may pass over the top and sides of a foot of a wearer and secure sole 102 to a foot of a wearer.

Figure 11:
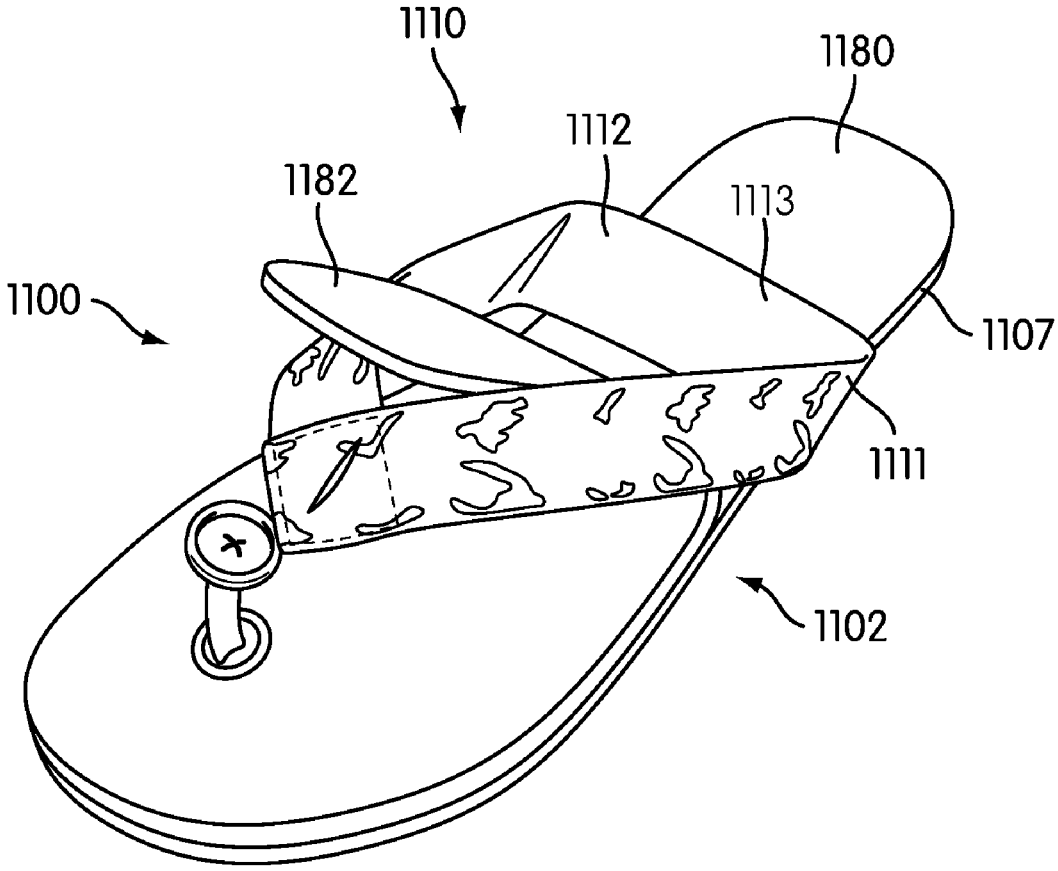
FIG. 11 is an exploded view of an alternative embodiment of an article of footwear.

Although the current embodiment discusses a strap with disjoint ends fixed to sole 102, in an alternative embodiment, a strap may be a continuous strap that is disposed through a sole. FIG. 11 illustrates an alternative embodiment of article of footwear 1100. Preferably, article of footwear 1100 may include any features described in other embodiments in this detailed description. In this embodiment, article of footwear 1100 includes sole 1102. In a manner substantially similar to the previous embodiment, sole 1102 comprises first sole portion 1180 joined with second sole portion 1182. Article of footwear 1100 also includes strap 1110. For clarity, second sole portion 1182 has been lifted up from first sole portion 1180 in order to clearly illustrate the placement of strap 1110. In should be understood however, that an assembled view of article of footwear 1100 would look substantially similar to article of footwear 100 seen in FIG. 1.

In this alternative embodiment, strap 1110 is configured as a continuous strap. With this configuration, a portion of strap 1110 may be disposed through sole 1102. In particular, first fixed end 1111 and second fixed end 1112 of strap 1110 may be disposed at periphery 1107. Furthermore, intermediate portion 1113 may be disposed over first sole portion 1180 and beneath second sole portion 1182.

In some embodiments, first sole portion 1180 and/or second sole portion 1182 could include provisions for receiving intermediate portion 1113 of strap 1110. For example, in some cases, first sole portion 1180 and/or second sole portion 1182 could include slots for receiving strap 1110. In this preferred embodiment, first sole portion 1180 and second sole portion 1182 are generally flat. Preferably, first sole portion 1180 and second sole portion 1182 are configured to slightly deform around intermediate portion 1113 to prevent substantial bulging of sole 1102 around intermediate portion 1113 of strap 1110.

Preferably, strap 1110 is fixedly joined to sole 1102. Generally, strap 1110 may be joined with sole 1102 in any manner. In some embodiments, strap 1110 may be glued between first sole portion 1180 and second sole portion 1182. In other embodiments, strap 1110 may be attached using another attachment method. Examples of other attachment methods include, but are not limited to, stapling, taping, sewing as well as other methods. Using this arrangement, strap 1110 may be securely attached to sole 1102.

Referring back to FIG. 1, strap 110 preferably includes first side 213 and second side 414. Second side 414 is disposed opposite of first side 213. In this embodiment, first side 213 is disposed upwardly and is visible to a wearer. In other words, second side 414 may be disposed against a foot of a wearer.

Generally, sides 213 and 414 may present various types of surfaces. In some embodiments, first side 213 and second side 414 may present similar types of surfaces. In other embodiments, first side 213 and second side 414 may present different types of surfaces. Examples of different types of surfaces include, but are not limited to, rubber surfaces, leather surfaces, textured surfaces, plastic surfaces, woven surfaces, as well as other types of surfaces.

In some embodiments, first side 213 of strap 110 may have a woven surface. Likewise, in some embodiments, second side 414 may have a woven surface. Generally, the width of the weaving associated with first side 213 and second side 414 could be any size. For example, in some embodiments, the width of a weave may vary between 1 mm and 50 mm. In some cases, first side 213 and second side 414 may have woven surfaces with different widths. In other cases, first side 213 and second side 414 could have woven surfaces with substantially similar widths. In still other cases, only one side of strap 110 may have a woven surface. In one exemplary embodiment, first side 213 of strap 110 may include a first weave with a first width. Additionally, second side 414 may include a second weave with a second width that is different from the first width. In a preferred embodiment, the first width of the first weave may be approximately 20.5 mm. Also, in the preferred embodiment, the second width of the second weave may be approximately 30 mm.

Generally, sides 213 and 414 may include different types of designs. In some embodiments, sides 213 and 414 may be also associated with one or more designs. In some cases, sides 213 and 414 may be associated with similar designs. In other cases, sides 213 and 414 may each be associated with different patterns. In one exemplary embodiment, first side 213 includes a camouflage pattern while second side 414 includes a plain design.

In some embodiments, strap 110 may include additional portions that attach to sole 102. In a preferred embodiment, strap 110 includes fastening portion 113. Fastening portion 113 may be disposed between first fixed end portion 111 and second fixed end portion 112. Using this configuration, fastening portion 113 may be oriented forward of fixed end portions 111 and 112 towards the toes of a foot.

Fastening portion 113 of strap 110 may be associated with fastener 120. In some embodiments, fastener 120 may include a single fastening member that releasably attaches fastening portion 113 to fastener 120. In a preferred embodiment, fastener 120 includes two fastening members that may releasably attach fastening portion 113 to fastener 120.

In this embodiment, fastener 120 includes first fastening member 121 and second fastening member 122. First fastening member 121 may be associated with first side 103 of sole 102. In a similar manner, second fastening member 122 may be associated with second side 104.

Generally, fastener 120 could be any type of fastener. In some embodiments, fastener 120 could be a molded plastic piece. In other embodiments, fastener 120 could be configured as webbing that is attached to one or more fastening members. In particular, fastener 120 may be enlarged at the ends to embrace first fastening member 121 and second fastening member 122 within the webbing. In some cases, the webbing could partially engulf first fastening member 121 and second fastening member 122. In other cases, the webbing could fully engulf first fastening member 121 and second fastening member 122.

Generally, a fastening portion of a strap may be releasably attached to a fastening member using any method known in the art. In some embodiments, a fastening portion and a fastening member may comprise a hook and loop type fastener. In a preferred embodiment, a fastening member may be a button and a fastening portion may be configured with a hole suitable for a button stitched with any style of stitching.

In this preferred embodiment, second fastening member 122 is substantially circularly shaped and configured to slide through fastening portion 113. In some cases, first fastening member 121 may be substantially similar in size and shape. Preferably, fastening portion 113 is configured with a tight whip stitch for a button hole. With this arrangement, fastening portion 113 may be releasably attached to second fastening member 122 of fastener 120.

Furthermore, fastener 120 may be associated with fastener gap 106 in sole 102. Specifically, fastener 120 may be disposed within fastener gap 106 and configured to move with respect to first side 103 and second side 104. In the current embodiment, first fastening member 121 may be disposed adjacent to first side 103 of sole 102. Likewise, second fastening member 122 may be disposed adjacent to second side 104 of sole 102. With this arrangement, fastener 120 may be secured to sole 102 near fastener gap 106.

For illustrative purposes, fastener 120 is shown here above sole 102. However, it should be understood that following assembly, fastener 120 is designed to be permanently engaged with sole 102. In other embodiments, fastener 120 could be detachable from sole 102. In particular, fastener gap 106 is preferably only large enough to receive a portion of fastener 120 disposed between first fastening member 121 and second fastening member 122. In other words, fastener gap 106 is preferably too small to allow either first fastening member 121 or second fastening member 122 to pass through fastener gap 106. With this arrangement, fastener 120 preferably cannot be removed from sole 102. This configuration helps increase the strength of the connection between fastener 120 and sole 102.

Generally, fastener gap 106 may be disposed in any portion of sole 102. In some cases, fastener gap 106 may be disposed along forward portion 105 of sole 102. In a preferred embodiment, fastener gap 106 may be disposed on sole 102 so that fastener 120 may fit between a first big toe and a second toe of a foot of a wearer when a foot is inserted into article 100.

An article of footwear with provisions for converting between two different appearances may be desirable for a consumer. In particular, a reversible article of footwear may be designed to allow a consumer to switch from one side of an article of footwear associated with a particular color and/or style to a second side of an article of footwear associated with a different color and/or style. This configuration provides the consumer with an option between two different appearances when purchasing a single reversible pair of footwear. In addition to cost savings, a reversible pair of footwear reduces the number of pairs of footwear that need to be packed for a trip or stored in a closet by providing two different styles and/or colors in one reversible pair of footwear.

For example, a reversible pair of footwear may have a first side that is green and a second side that is red. When a wearer configures the reversible pair of footwear in a first position with the first side contacting a ground surface, the pair of footwear will be a red pair of footwear. Alternatively, when the wearer configures the reversible pair of footwear in a second position with the second side contacting the ground surface, the pair of footwear will be a green pair of footwear. With this arrangement, a single reversible pair of footwear provides both a red pair and a green pair of footwear.

In addition, as previously discussed, sides of a sole may have different types of textured surfaces. The different textures on the sides of the sole allow a wearer to configure an article so that a particular texture contacts a ground surface while a second different texture is disposed against a foot. In some cases, a wearer may choose a texture associated with a side of a sole to contact a ground surface for traction purposes. In other cases, a wearer may choose a texture associated with a side of a sole to contact a foot for sensorial reasons or for stimulation of the foot. For example, a reversible article of footwear may have a first side that is smooth and a second side that has a textured surface. When the article of footwear is configured in a first position with the first side contacting a ground surface, a smooth surface with little traction may contact the ground. In this case, the second side with the textured surface may be disposed against a foot and provide therapeutic or sensorial stimulation. Alternatively, the article of footwear may be configured in a second position with the second side contacting a ground surface. Preferably, the second side with the textured surface increases traction for the article. Also, in this configuration, the first side provides a smooth surface for a foot of a wearer. Using this preferred arrangement, a reversible pair of footwear may provide two different textured surfaces when configured in a first or second position for a set of feet and a ground surface.

Preferably, article of footwear 100 may be configured as a reversible pair of footwear. As previously discussed, sole 102 includes first side 103 and second side 104. In a first position, illustrated in FIG. 2, first side 103 may be configured to contact a ground surface while second side 104 may receive a left foot of a wearer. Furthermore, first side 213 of strap 110 may be visible to a wearer while second side 414 is disposed against a foot of a wearer. In addition, when article of footwear 100 is configured in a first position, second fastening member 122 will be visible through fastening portion 113 while first fastening member 121 is disposed against first side 103 and may contact a ground surface. Using this arrangement, article of footwear 100 may present a first appearance when configured in a first position.

Figure 8:
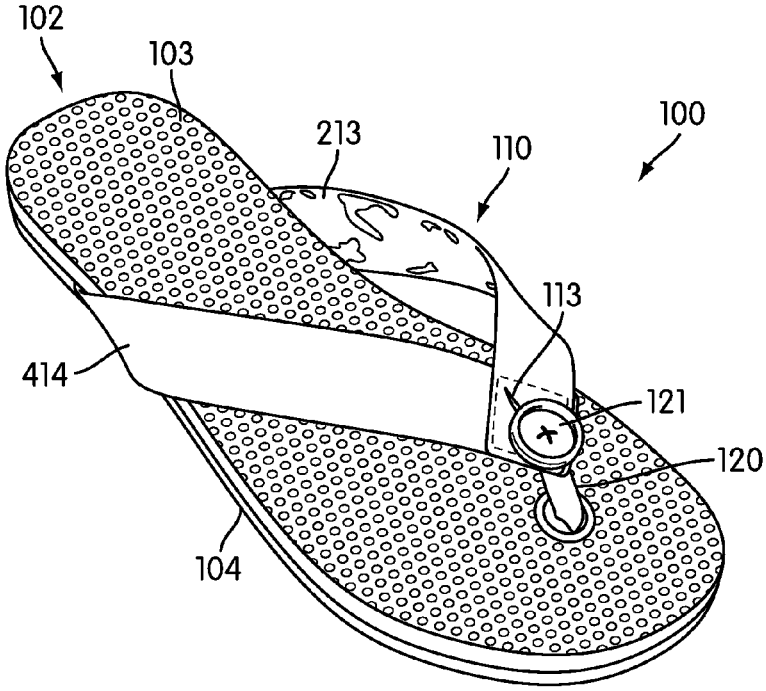
FIG. 8 is an assembled isometric view of a preferred embodiment of an article of footwear in a second position configured for a right foot.

Alternatively, article of footwear 100 may be configured to receive a right foot of a wearer when article of footwear 100 is in a second position with second side 104 disposed to contact a ground surface, as seen in FIG. 8. In this second position, first side 103 of sole 102 will be visible to a wearer. In addition, second side 414 of strap 110 may be visible to a wearer while first side 213 may be disposed against a foot of a wearer. Also, first fastening member 121 may be inserted through fastening portion 113 and visible to a wearer when article of footwear 100 is configured in this first position. Furthermore, second fastening member 122 may be disposed against second side 104 of sole 102 and may contact a ground surface. With this configuration, article of footwear 100 may present a second distinct appearance when configured in the second position.

Throughout this specification, it should be understood that not only a single article of footwear, but a pair of footwear may be configured to be reversible. While this embodiment describes article of footwear 100 associated with a left foot when configured in a first position and associated with a right foot when configured in a second position, it should be understood that a second, complementary, article of footwear may also be reversible. In particular, a complementary article of footwear for article of footwear 100 may be associated with a right foot when configured in a first position and associated with a left foot when configured in a second position. Generally, complementary articles of footwear will appear substantially similar in color and design when complementary articles of footwear are in similar, either first or second, positions.

Generally, the components associated with article of footwear 100 may be made of any materials. Preferably, a strap of a reversible article of footwear is manufactured from a flexible and sturdy material. Generally, the strap may be constructed from any material capable of rotating around a heel of an article of footwear and fastening to a fastener while presenting an aesthetically pleasing appearance. In some embodiments, each side of the strap may be constructed from two different materials. In other embodiments, each side of the strap may be constructed with the same material with two different appearances. In some cases, each side of the strap will create a different appearance when the article of footwear is in a first and a second position. In still other embodiments, each side of the strap may be constructed with the same material and present the same appearance.

In some embodiments, a strap may be made of a polymer. In some cases, a strap may be constructed from a synthetic material such as molded thermoplastic polyurethane. In other embodiments, a strap may be manufactured from a textile. In some cases, a strap manufactured from a textile may include a weaving. In a preferred embodiment, a strap may be constructed from a textile with different weaves and colors on each side.

Also, preferably, a sole of a reversible article of footwear is constructed of a flexible and durable material. In some embodiments, a sole may be constructed of rubber. In other embodiments, a sole may be constructed of a synthetic material including, but not limited to, thermoplastic materials. In a preferred embodiment, a sole may be constructed of ethylene vinyl acetate (EVA).

Typically, a sole may be constructed by any known method in the art. In some embodiments, a first sole portion associated with a first side of a sole may be attached with adhesives to a second sole portion associated with a second side of a sole. In other embodiments, two sole portions may be attached to create a sole using a combination of adhesives, heat and pressure. For example, in some cases, prior to attaching the sole portions of a sole together, first and second fixed end portions of a strap may be inserted and fixed between the two sole portions of a sole. Using this configuration, the sole may secure the two fixed end portions of the strap at a periphery of the sole and provide the strap the ability to rotate so that the strap may be disposed on either side of the sole.

Preferably, the process of converting a reversible pair of footwear from a first position to a second position and vice versa is relatively easy for a wearer. FIGS. 2-8 illustrate a preferred embodiment of a process of converting reversible article of footwear 100 from a first position to a second position. It should be noted that article of footwear 100 may be associated with a left foot when configured in a first position and associated with a right foot when configured in a second position.

Figure 2:
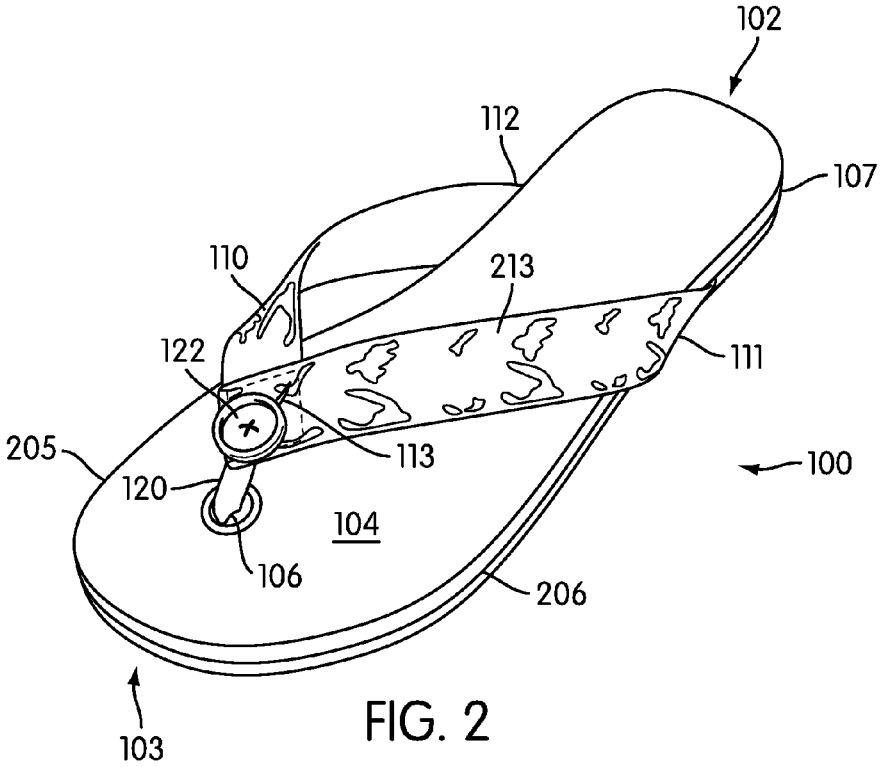
FIG. 2 is an assembled isometric view of a preferred embodiment of an article of footwear in a first position configured for a left foot.

Referring to FIG. 2, article of footwear 100 is assembled in a first position with first side 103 of sole 102 configured to contact a ground surface and second side 104 configured to receive a left foot of a wearer. With article of footwear 100 in this first position, fastener 120 is configured with first fastening member 121, not visible in FIG. 2, disposed against first side 103. In some cases, first fastening member 121 may be fitted into a recess disposed around fastener gap 106 so first fastening member 121 is flush with first side 103. With this arrangement, second fastening member 122 is disposed away from second side 104 and extends above second side 104.

With second fastening member 122 extending above second side 104, fastening portion 113 of strap 110 may be releasably attached to second fastening member 122. This may be achieved by buttoning second fastening member 122 through fastening portion 113. This arrangement allows strap 110 to be secured to sole 102 by fastener 120.

Furthermore, first fixed end portion 111 of strap 110 is attached to periphery 107 on lateral side 206 of sole 102. Additionally, second fixed end portion 112 is attached to periphery 107 on medial side 205 of sole 102. This arrangement secures strap 110 to sole 102. Also, first side 213 of strap 110 is disposed away from sole 102 so that first side 213 is visible to a wearer when article of footwear 100 is configured in the first position.

Figure 3:
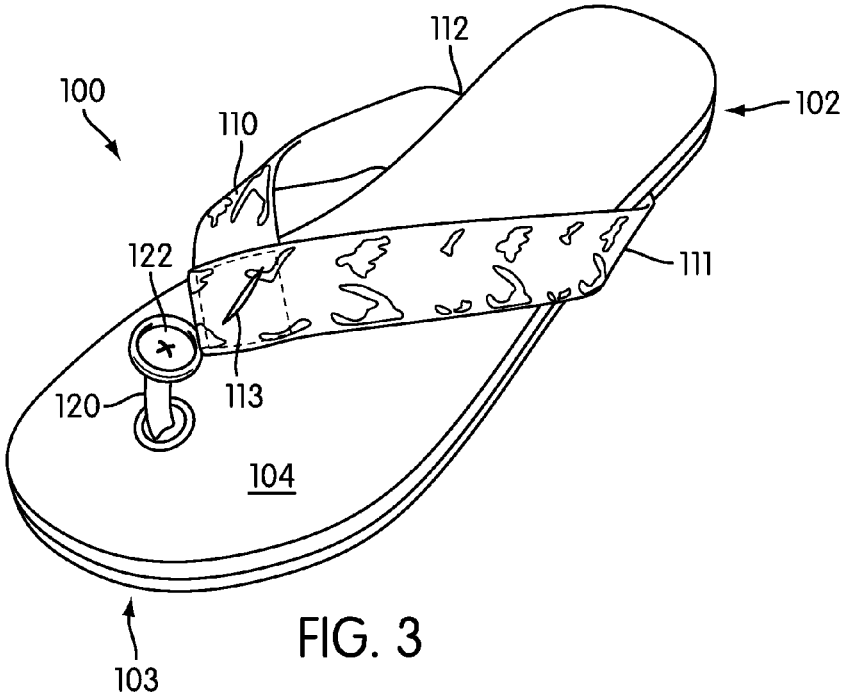
FIG. 3 is an isometric view of a preferred embodiment of an article of footwear in a first position with a strap unfastened from a fastener.

In order to convert article of footwear 100 from a first position to a second position, fastening portion 113 of strap 110 must be unfastened from second fastening member 122 of fastener 120. Referring to FIG. 3, second fastening member 122 is released from fastening portion 113. This may be accomplished by unbuttoning second fastening member 122 from fastening portion 113. At this point, a portion of strap 110 may be released from sole 102.

Figure 4:
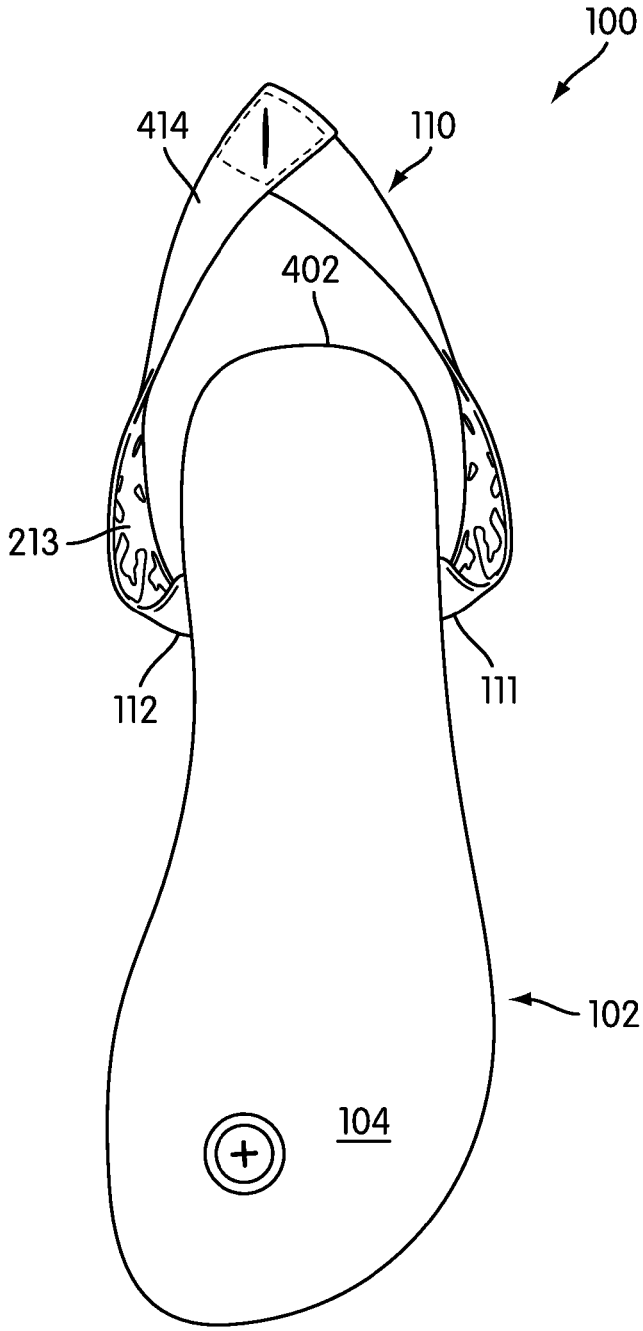
FIG. 4 is a plan view of a preferred embodiment of an article of footwear converting from a first position to a second position.

Following the release of strap 110, strap 110 may be rotated around heel portion 402 of sole 102 as seen in FIG. 4. This rotation preferably causes fixed end portions 111 and 112 to twist and turn over to expose second side 414 of strap 110. By rotating strap 110 around heel portion 402, a wearer may convert article 100 from the first position to a second position.

Figure 5:
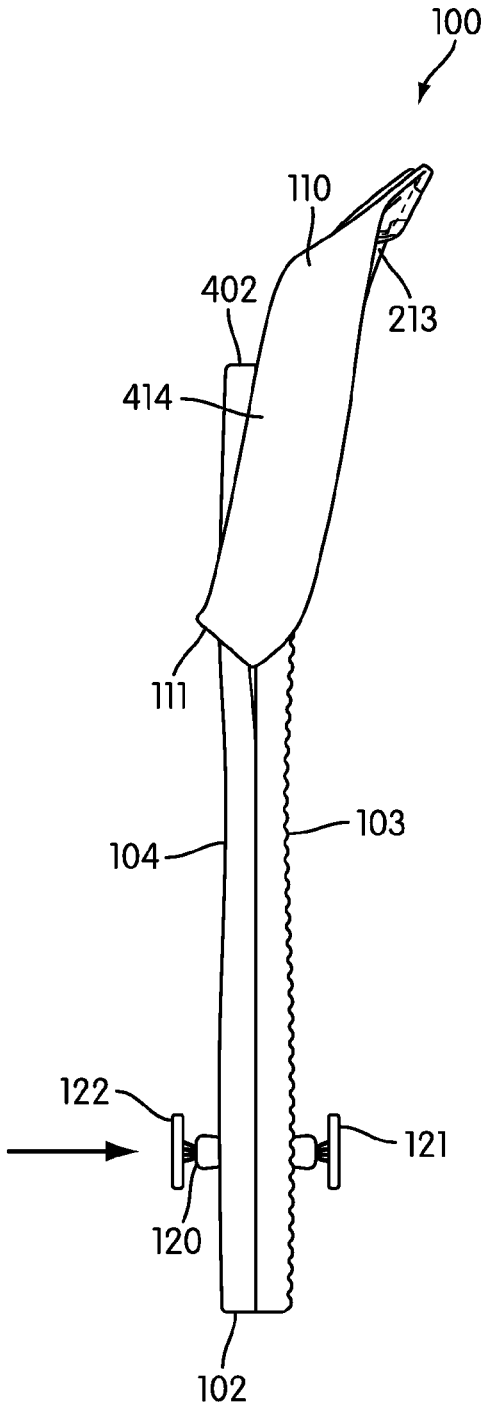
FIG. 5 is a side view of a preferred embodiment of an article of footwear converting from a first position to a second position.

FIG. 5 illustrates a side view of a preferred embodiment of article of footwear 100. As article of footwear 100 is converted to a second position, fastener 120 may be configured to move with respect to first side 103 and second side 104. In particular, fastener 120 may be pushed through sole 102 so that second fastening member 122 is disposed adjacent to second side 104. This may be accomplished by pushing second fastening member 122 until second fastening member 122 is flush with second side 104 and configured in the second position. Using this arrangement, first fastening member 121 may be disposed away from first side 103 and extend over first side 103 when article 100 is configured in a second position. Furthermore, strap 110 may be rotated past heel portion 402. With this arrangement, strap 110 may be disposed over first side 103 of sole 102.

Figure 6:
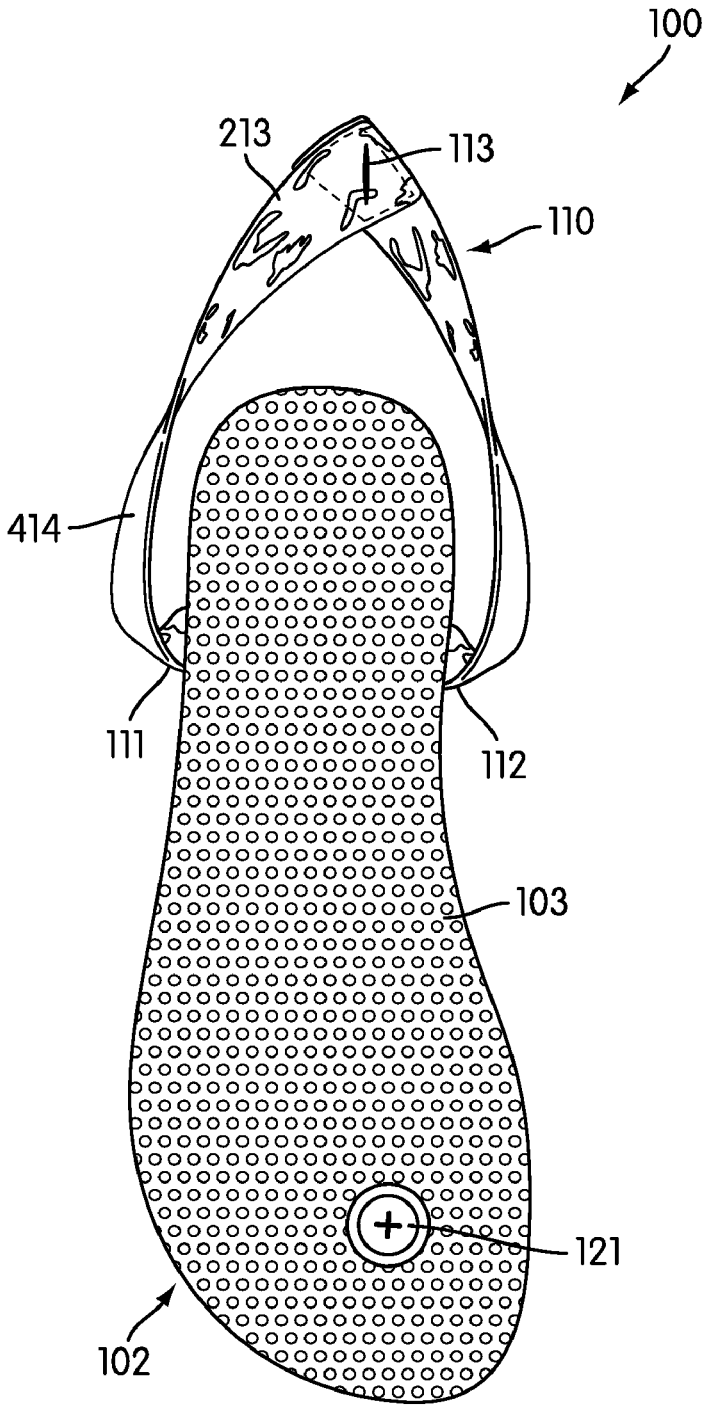
FIG. 6 is a plan view of a preferred embodiment of an article of footwear converting from a first position to a second position.

Referring to FIG. 6, sole 102 is turned over with respect to FIG. 4 so that first side 103 faces upward. This furthers the process of converting article of footwear 100 from a first position to a second position. In this second position, second side 104 (not visible in FIG. 6) is configured to contact a ground surface and first side 103 is configured to receive a right foot of a wearer. By turning over sole 102, article 100 converts from a configuration for a left foot in the first position to a configuration for a right foot in the second position.

Figure 7:
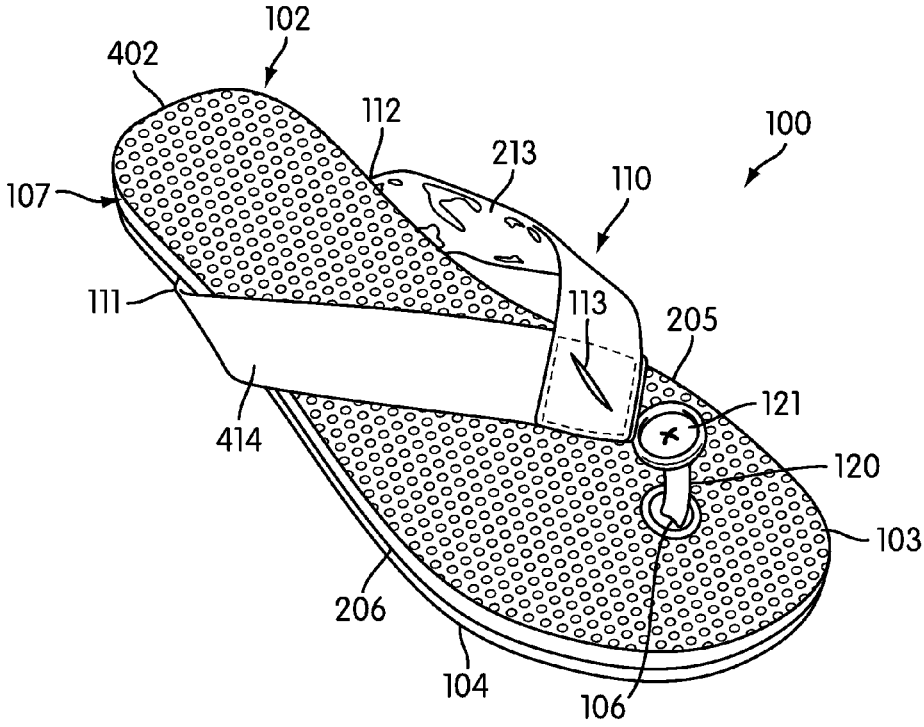
FIG. 7 is an isometric view of a preferred embodiment of an article of footwear in a second position with a strap unfastened from a fastener.

At this point, strap 110 may be disposed above first side 103 as seen in FIG. 7. With this arrangement, second side 414 of strap 110 is disposed away from sole 102 and visible to a wearer in the second position. First side 213 of strap 110 may now be disposed against a foot of a wearer. It may be noted that first fixed end portion 111 of strap 110 remains fixedly attached to periphery 107 of sole 102 on lateral side 206. Similarly, second fixed portion 112 remains fixedly attached to periphery 107 of sole 102 on medial side 205.

In order to releasably attach fastening portion 113 to first fastening member 121, first fastening member 121 may be disposed away from first side 103. This may be accomplished by pushing fastener 120 through fastener gap 106 of sole 102. As previously discussed in reference to FIG. 5, second fastening member 122, not visible in FIG. 7, may be pushed until it is disposed adjacent to, and in some cases flush with, second side 104. With this arrangement, first fastening member 121 is disposed away from first side 103 and extends above first side 103 in this second position.

Referring to FIG. 8, the conversion of article of footwear 100 to a second position is completed by releasably attaching fastening portion 113 to first fastening member 121. Generally, this fastening may be accomplished through any means known in the art. As previously discussed, in this embodiment, fastening portion 113 may be releasably attached to first fastening member 121 by buttoning. With this arrangement, article of footwear 100 is now in a second position and configured to receive a right foot of a wearer. In this second position, article of footwear 100 provides a second appearance with first side 103 facing upward and second side 414 of strap 110 disposed away from first side 103 and visible to a wearer.

While the embodiment illustrated in FIGS. 2-8 detail a process of converting an article of footwear from a first position to a second position, it should be understood that the steps may be followed in reverse to convert an article from a second position to a first position. Furthermore, the process of converting an article of footwear between positions may be repeated on a complementary article of footwear in order to convert a pair of footwear to a desired position.

By providing different colors and/or textures on two sides of a pair of soles, a pair of footwear may be configured to create two distinct appearances when configured in a first or second position. Additionally, straps associated with the pair of footwear may be configured with different colors and/or textures to create two different appearances when a pair of footwear is in a first position or a second position. Preferably, a reversible pair of footwear equips a wearer with the appearance of two different pairs of shoes. With this arrangement, a wearer may benefit with cost savings and enjoy choosing a particular appearance associated with a first or second position of a reversible pair of footwear.

Figure 9:
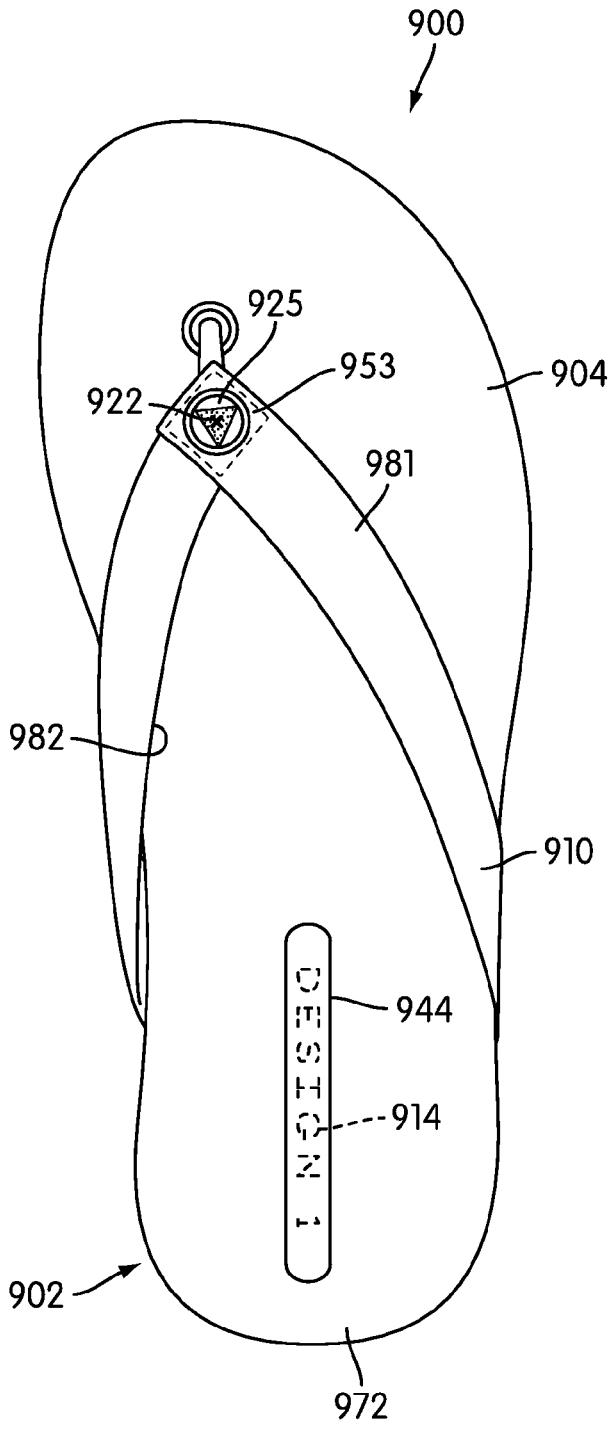
FIG. 9 is a top view of an exemplary embodiment of an article of footwear in a first position configured for a right foot.
Figure 10:
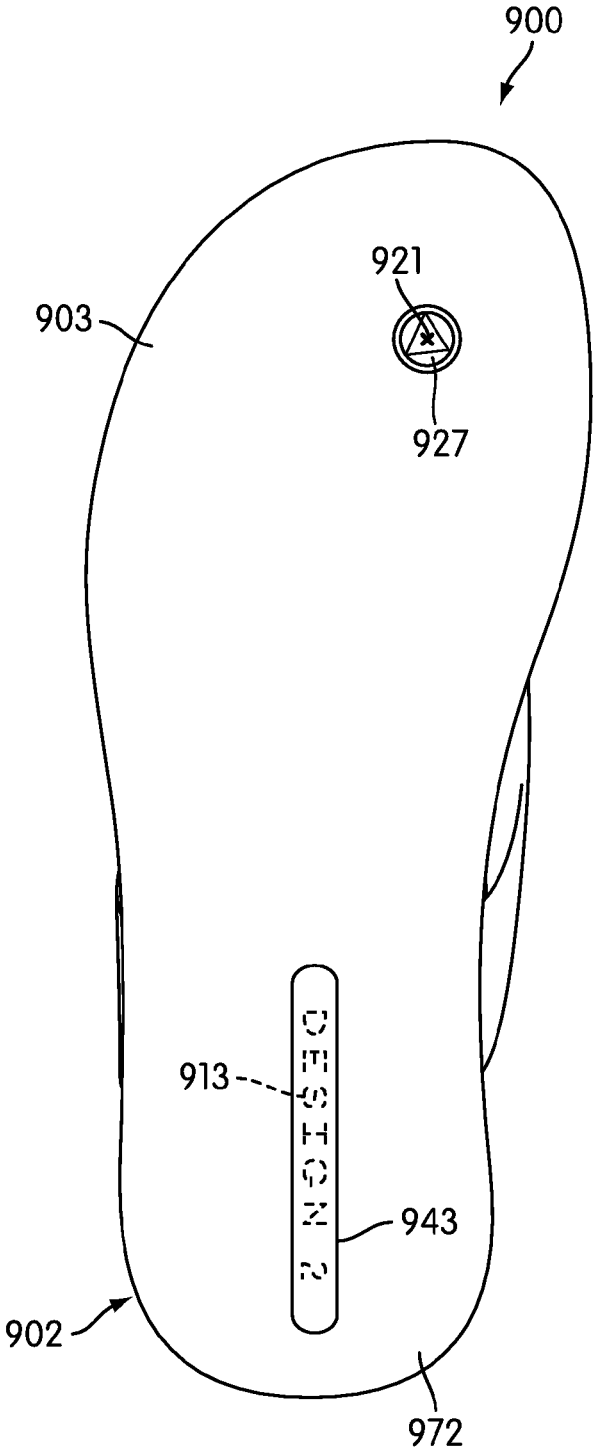
FIG. 10 is a bottom view of an exemplary embodiment of an article of footwear in a first position configured for a right foot.

FIGS. 9-10 illustrate an exemplary embodiment of article of footwear 900 including additional provisions for modifying the aesthetic appearance of article of footwear 900 between a first position and a second position. For illustrative purposes, only a single article of footwear is shown in the current embodiment. However, it should be understood that a complementary article of footwear includes identical details to create a pair of footwear. Furthermore, this embodiment preferably includes all features discussed in the previous embodiments.

Referring to FIGS. 9-10, article of footwear 900 is in a first position with second side 904 of sole 902 configured to receive a right foot of a wearer and first side 903 configured to contact a ground surface. Second fastening member 922 extends above second side 904 in this first position while first fastening member 921 is disposed flush against first side 903. Preferably, fastening portion 953 of strap 910 is releasably attached to second fastening member 922 in this first position. In addition, first side 981 of strap 910 is disposed away from sole 902 while second side 982 may be disposed against a foot of a wearer. With this arrangement, article of footwear 900 is in the first position and configured to receive a right foot of a wearer.

Generally, sides of a sole may include colors, pattern and indicia. In some embodiments, a first side of a sole may include different colors, patterns and/or indicia than a second side. In some cases, the patterns or indicia may be raised or indented on a sole to different heights or depths on different sides of the sole. In other embodiments, a first side and a second side may include the same pattern, color and/or indicia.

Preferably, a sole may present different designs according to whether an article is in a first position or a second position. In this exemplary embodiment, sides 903 and 904 of sole 902 include first recess 943 and second recess 944, respectively, disposed on heel portion 972. In some cases, recesses 943 and 944 may be indented approximately 0.75 mm into first side 903 and second side 904, respectively. Furthermore, in this embodiment, recesses 943 and 944 both include written designs. In particular, second recess 944 includes second design 914. In a similar manner, first recess 943 includes first design 913. It should be understood that designs 913 and 914 are only intended to be exemplary and in other embodiments any type of words, indicia, or other designs may be associated with recesses 943 and 944, respectively.

In the first position, second recess 944 with second design 914 faces upward. In this configuration, first recess 943 with first design 913 may contact a ground surface. When article of footwear 900 is converted to a second position, first recess 943 with first design 913 will face upward and may contact a foot of a wearer. Additionally, second recess 944 with second design 914 may be disposed against a ground surface. In this manner, recesses 943 and 944, including designs 913 and 914, respectively, provide different appearances for article of footwear 900 when configured in a first and second position.

Preferably, a fastener may present different indicia according to whether an article is in a first position or a second position. In this embodiment, first fastening member 921 and second fastening member 922 provide different appearances for article of footwear 900 when article of footwear 900 is configured in a first and second position. In particular, second fastening member 922 associated with second side 904 includes a button with second indicia 925. In a similar manner, first fastening member 921 associated with first side 903 includes a button with first indicia 927. Generally, indicia included on fastening members 921 and 922 may be raised or indented. In this embodiment, indicia 925 and 927 are raised approximately 0.25 mm. Preferably, second indicia 925 and first indicia 927 have different colors and are oriented in different directions. In this first position, second indicia 925 may be visible on top of a foot of a wearer and provide a distinct appearance. First indicia 927, disposed with first fastening member 921 flush against first side 903, may be visible at times and provide decoration on the bottom of article of footwear 900.

If, however, article of footwear 900 is converted to a second position with first side 903 configured to contact a foot of a wearer, first indicia 927 on first fastening member 921 will become visible on top of the foot of a wearer. Since first indicia 927 is different than second indicia 925 article of footwear 900 presents a different appearance in this second position. Furthermore, second indicia 925 may be visible at times on second side 904 even though second side 904 is configured to contact a ground surface in this second position. Preferably, second indicia 925 may provide decoration on second side 904 when configured in this second position.

By differentiating the patterns, indicia, and/or colors on a first side and a second side of a sole as well as a first and second fastening member, an article of footwear may present a different appearance when configured in a first position with a second side of a sole and a second fastening member disposed upward and when configured in a second position with a first side of a sole and a first fastening member disposed upward. Furthermore, a first side and a second side of a strap may include different colors, patterns, weaving and/or indicia to provide alternative appearances for an article of footwear when configured in a first position with a first side of a strap visible or in a second position with a second side of a strap visible. With this arrangement, a consumer may purchase a single reversible pair of footwear and receive the appearance of two different pairs of footwear.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

I claim:

1. An article of footwear, comprising:

a sole including a first side that is a ground contacting surface in a first position, a second side that is a ground contacting surface in a second position, and a fastener gap extending through the sole from the first side to the second side;

a strap including a first fixed end portion and a second fixed end portion, each fixed end portion being fixedly attached to a periphery of the sole;

the strap further including a fastening portion that is disposed between the first fixed end portion and the second fixed end portion;

a fastener having a flexible central portion passing through the fastener gap, the fastener being longer than the fastener gap and including a first button associated with the first side of the sole and a second button associated with the second side of the sole;

wherein, in the first position, the first button is disposed against the first side of the sole and the second button extends above the second side such that a first toe and a second toe of a foot of a wearer may fit around the central portion between the second button and the second side;

wherein, in the second position, the second button is disposed against the second side of the sole and the first button extends above the first side such that the first toe and the second toe of the foot of the wearer may fit around the central portion between the first button and the first side;

wherein the fastener slides within the fastener gap in a first direction such that the central portion extends above the second side in the first position and in a second direction such that the central portion extends above the first side in the second position; and wherein the fastening portion of the strap is releasably attached to the second button in the first position and wherein the fastening portion of the strap is releasably attached to the first button in the second position.

2. The article of footwear according to claim 1, wherein the strap is a continuous strap and the sole has a first sole portion and a second sole portion, an intermediate portion of the strap being disposed over the first sole portion and beneath the second sole portion.

3. The article of footwear according to claim 2, wherein the first sole portion and the second sole portion both slightly deform around the intermediate portion of the strap.

4. The article of footwear according to claim 3, wherein the first button is associated with a first indicia and the second button is associated with a second indicia that is different from the first indicia.

5. The article of footwear according to claim 4, wherein the sole has a heel portion and a forward portion opposite the heel portion and wherein the fastening portion includes a button hole enabling the first button to pass through the button hole to secure the strap to the fastener in the second position such that the fastener is prevented from slipping out of the button hole in both a direction of the heel portion and a direction of the forward portion, the button hole enabling the second button to pass through the button hole to secure the strap to the fastener in the first position such that the fastener is prevented from slipping out of the button hole in both a direction of the heel portion and a direction of the forward portion.

6. The article of footwear according to claim 5, wherein the button hole includes stitched edges.

7. An article of footwear, comprising:

a sole including a first side that is a ground contacting surface in a first position and a second side that is a ground contacting surface in a second position;

a fastener extending through the sole and including a central portion, a first fastening member disposed at a first end of the central portion and associated with the first side of the sole, and a second fastening member disposed at a second end of the central portion and associated with the second side of the sole;

a strap including a fastening portion that releasably attaches to the fastener;

wherein the fastener is movable such that the first fastening member is disposed against the first side and the second fastening member extends above the second side in the first position and the second fastening member is disposed against the second side and the first fastening member extends above the first side in the second position;

wherein the central portion extends above the second side and fits between a first toe and a second toe of a foot of a wearer when the foot is inserted into the article of footwear and the sole is in the first position;

wherein the central portion extends above the first side and fits between the first toe and the second toe of the foot of the wearer when the foot is inserted into the article of footwear and the sole is in the second position; and wherein the sole includes a fastener gap extending from the first side to the second side, the fastener gap being shorter than the fastener and the fastener sliding within the fastener gap in a first direction such that the central portion extends above the second side in the first position and in a second direction such that the central portion extends above the first side in the second position, and wherein the central portion of the fastener is flexible.

8. The article of footwear according to claim 7, wherein the first fastening member is flush with the first side in the first position and the second fastening member is flush with the second side in the second position.

9. The article of footwear according to claim 7, wherein the strap includes a first side that is disposed away from the sole in the first position and a second side that is disposed away from the sole in a second position.

10. The article of footwear according to claim 9, wherein the fastener gap has a first recess on the first side of the sole and a second recess on the second side of the sole, the first recess receives the first fastening member such that the first fastening member is flush with the first side in the first position, and the second recess receives the second fastening member such that the second fastening member is flush with the second side in the second position.

11. The article of footwear according to claim 9, wherein the central portion of the fastener includes a webbing material.

12. The article of footwear according to claim 7, wherein the first side of the sole includes a different color or pattern than a color or pattern of the second side of the sole.

13. The article of footwear according to claim 7, wherein the strap includes a first side that is disposed away from the sole in the first position and a second side that is disposed away from the sole in a second position and wherein the first side of the strap has a first weave and the second side of the strap has a second weave that is different from the first weave.

14. The article of footwear according to claim 7, wherein the strap includes a first side that is disposed away from the sole in the first position and a second side that is disposed away from the sole in a second position and wherein the first side of the strap has a different pattern than the pattern of the second side of the strap.

15. The article of footwear according to claim 7, wherein the first side of the sole has a textured surface and the second side of the sole has a smooth surface.

16. The article of footwear according to claim 10, wherein the fastening portion includes a button hole and the first fastening member and the second fastening member each include a button, and wherein the first fastening member is buttoned through the fastening portion in the second position and the second fastening member is buttoned through the fastening portion in the first position.

17. An article of footwear, comprising:

a sole including a first side that is a ground contacting surface in a first position, a second side that is a ground contacting surface in a second position, and a fastener gap extending through the sole from the first side to the second side;

a strap including a first fixed end portion and a second fixed end portion, each fixed end portion being fixedly attached to a periphery of the sole;

wherein the strap further includes a fastening portion that is disposed between the first fixed end portion and the second fixed end portion;

a fastener that passes through the fastener gap, the fastener being longer than the fastener gap and including a flexible central portion that fits between a first toe and a second toe of a wearer, a first fastening member disposed at a first end of the central portion and associated with the first side of the sole, and a second fastening member disposed at a second end of the central portion and associated with the second side of the sole;

wherein the first fastening member releasably attaches to the fastening portion in the second position and the second fastening member releasably attaches to the fastening portion in the first position;

wherein the fastener gap is sufficiently large to slidingly receive the fastener and the fastener gap is sufficiently small to prevent the first fastening member and the second fastening member to pass through the fastener gap;

wherein the first fastening member is disposed adjacent to the first side of the sole and the second fastening member is disposed adjacent to the second side of the sole; and wherein the fastener slides within the fastener gap in a first direction such that the central portion extends above the second side in the first position and in a second direction such that the central portion extends above the first side in the second position.

18. The article of footwear according to claim 17, wherein the strap includes a first side that is disposed away from the sole in the first position and a second side that is disposed away from the sole in a second position.

19. The article of footwear according to claim 18, wherein the central portion extends above the second side a sufficient distance to fit between the first toe and the second toe of the foot of the wearer in the first position and the central portion extends above the first side a sufficient distance to fit between the first toe and the second toe of the foot of the wearer in the second position.

20. The article of footwear according to claim 17, wherein the strap is a continuous strap.

* * * * *